US006964386B2

(12) United States Patent
Ho

(10) Patent No.: US 6,964,386 B2
(45) Date of Patent: Nov. 15, 2005

(54) PAPER SHREDDER WITH AUXILIARY SWITCH

(76) Inventor: Ming-Hui Ho, No. 18, 20 Lane, Hsin Feng Street, Hsin Chuang City, Taipei Shien (TW)

( * ) Notice: Subject to any disclaimer, the term of this patent is extended or adjusted under 35 U.S.C. 154(b) by 168 days.

(21) Appl. No.: 10/728,919

(22) Filed: Dec. 8, 2003

(65) Prior Publication Data

US 2005/0121551 A1 Jun. 9, 2005

(51) Int. Cl.[7] ..... B02C 1/08; B02C 23/00
(52) U.S. Cl. ..... 241/236; 241/36; 241/100
(58) Field of Search ..... 241/236, 100, 241/36

(56) References Cited

U.S. PATENT DOCUMENTS 4,957,243 A * 9/1990 Kanagaki et al. ..... 241/34
5,775,605 A * 7/1998 Tsai ..... 241/36
6,116,528 A * 9/2000 Schwelling ..... 241/36
2002/0100827 A1 * 8/2002 Ho ..... 241/100
2004/0188553 A1 * 9/2004 Lo ..... 241/36

* cited by examiner

*Primary Examiner*—Derris H. Banks
*Assistant Examiner*—Faye Francis
(74) *Attorney, Agent, or Firm*—Bacon & Thomas PLLC

(57) ABSTRACT

A paper shredder with an auxiliary switch configured on an entrance of a top cover. A pressure rod of the auxiliary switch is sleeved in a spring and penetrates an inner side of the top cover, and further passes through an aperture defined in a flat plate, and thereupon compresses a contact plate; which then activates a contact switch to actuate a motor to rotate two rotary cutters. A spindle of a shaft lever configured on one end of the contact plate inserts into one end of a turning axle, and a paper shredder switch is configured on another end of the turning axle. Upon inserting paper into the entrance, the paper presses down on the paper shredder switch, and thereon activates the contact switch, which actuates the motor to begin shredding of the paper. Pressing the auxiliary switch initiates cleaning away the entrance of any shredded paper remnants.

3 Claims, 5 Drawing Sheets

PAPER SHREDDER WITH AUXILIARY SWITCH

BACKGROUND OF THE INVENTION (a) Field of the Invention

The present invention relates to paper shredders, and more particularly to a paper shredder with auxiliary switch configured on a perimeter of an entrance of the top cover. Pressing the auxiliary switch can initiate cleaning away the entrance of any remnants of bits of shredded paper.

(b) Description of the Prior Art

Referring to FIG. 1, which shows a conventional paper shredder, comprising a top cover 100, a base 200, a trash can 300 and switch 400. The top cover 100 is provided with an entrance 101 defined to allow insertion of waste paper therein. When in operation, the paper shredder automatically allows shredded paper to fall into the trash can 300. However, the paper shredder cannot completely shred a sheet of waste paper and clear away all leftover residue of the sheet of paper from the entrance 101 of the paper shredder, a portion of shredded paper remnants will remain within the entrance 101, and thereby hinder subsequent usage of the paper shredder.

The present invention provides an improved paper shredder to overcome the aforementioned shortcomings.

SUMMARY OF THE INVENTION

A primary objective of the present invention is to provide an auxiliary switch configured on an entrance of a conventional paper shredder, whereby after the paper shredder has shredded paper, in order to clear away remnants of bits of shredded paper remaining in the entrance, a user can press the auxiliary switch and thereby initiate cleaning away the entrance of the paper remnants, thus benefiting subsequent usage of the paper shredder, as well as allowing the next user to utilize the paper shredder unhindered.

Other objectives, advantages and novel features of the present invention will become more apparent from the following detailed description when taken in conjunction with the accompanying drawings.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
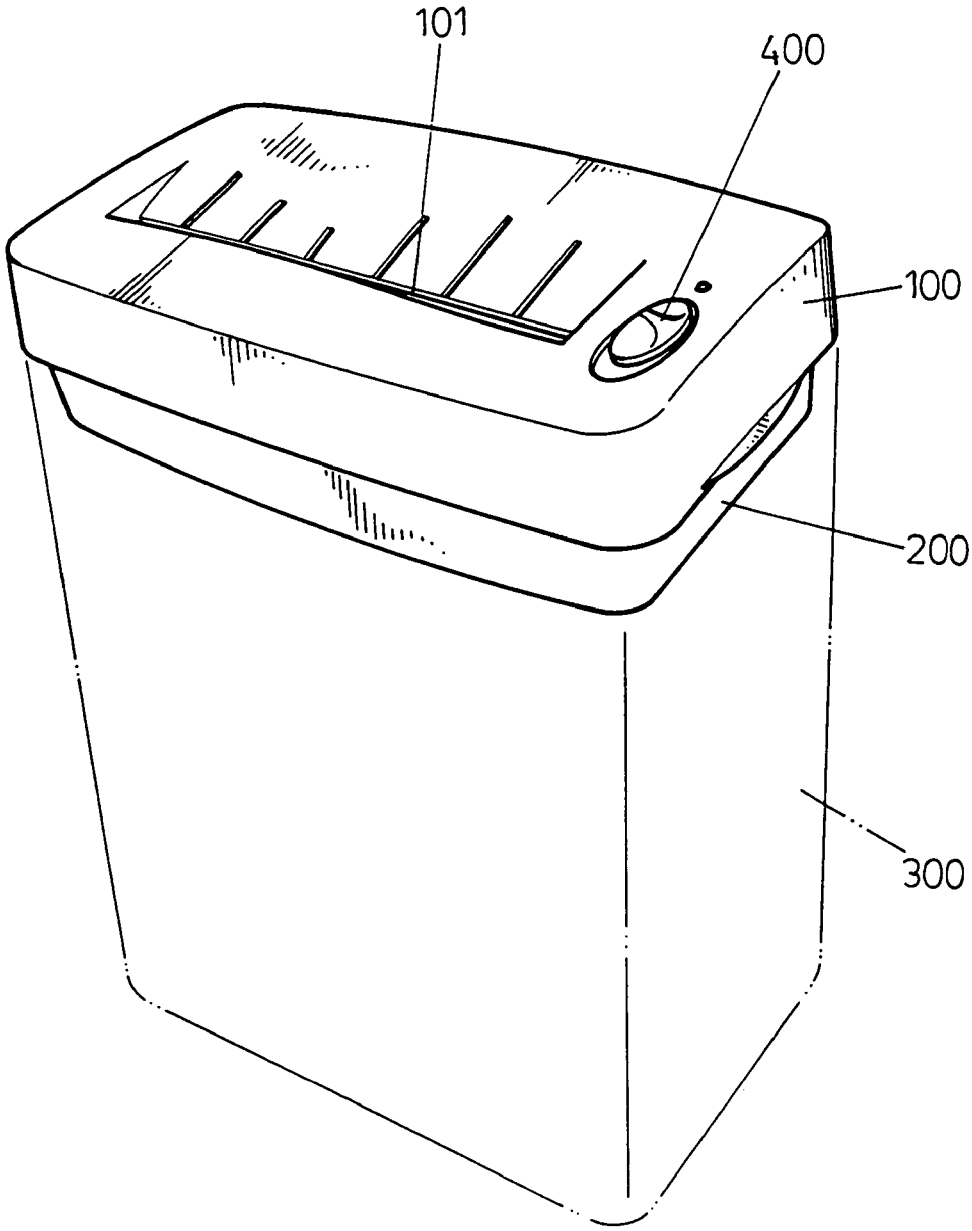
FIG.1 (PRIOR ART)
FIG. 1 shows an elevational view of a conventional paper shredder.
Figure 2:
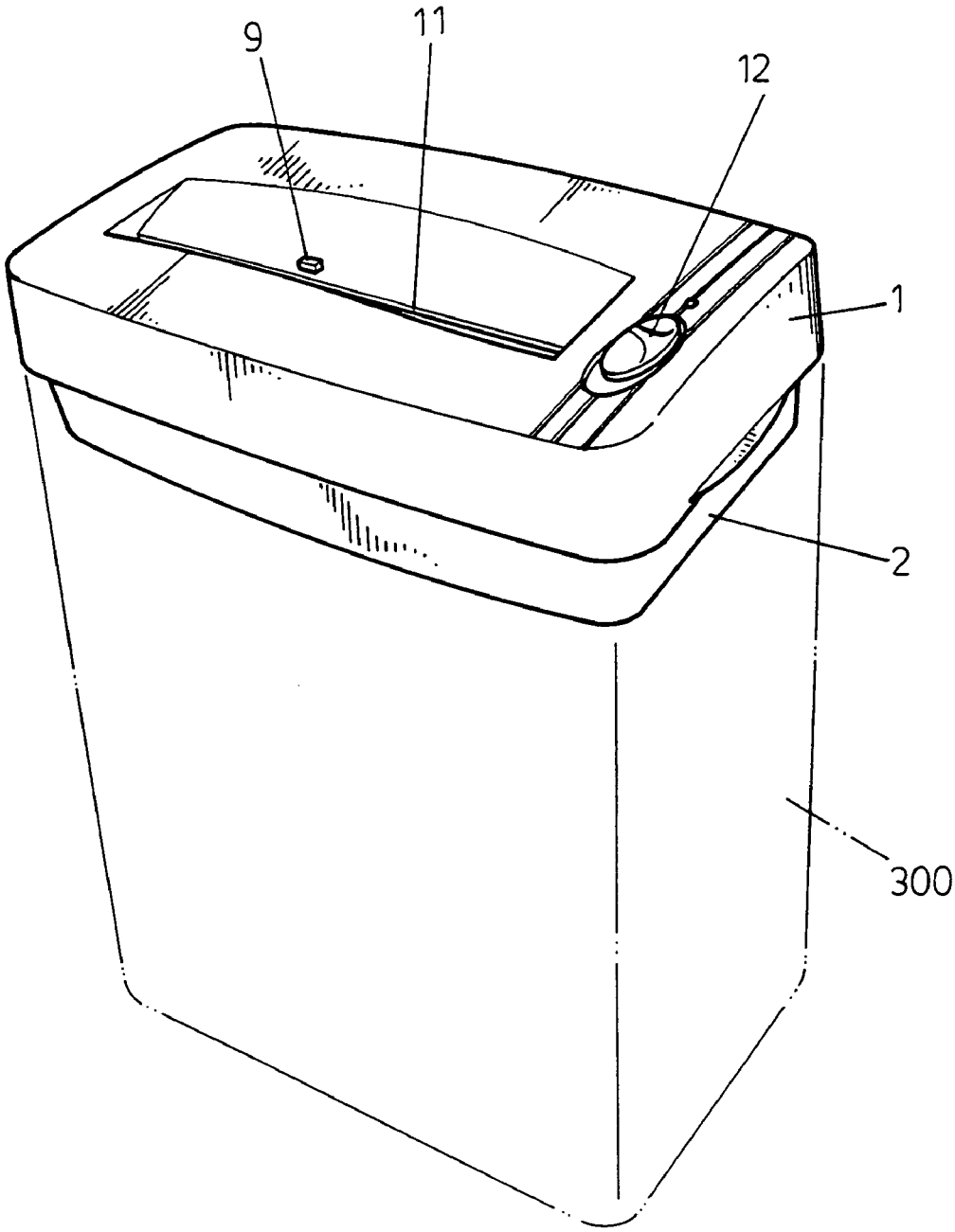
FIG. 2 shows an elevational view of a main body of a paper shredder with auxiliary switch according to the present invention.
Figure 3:
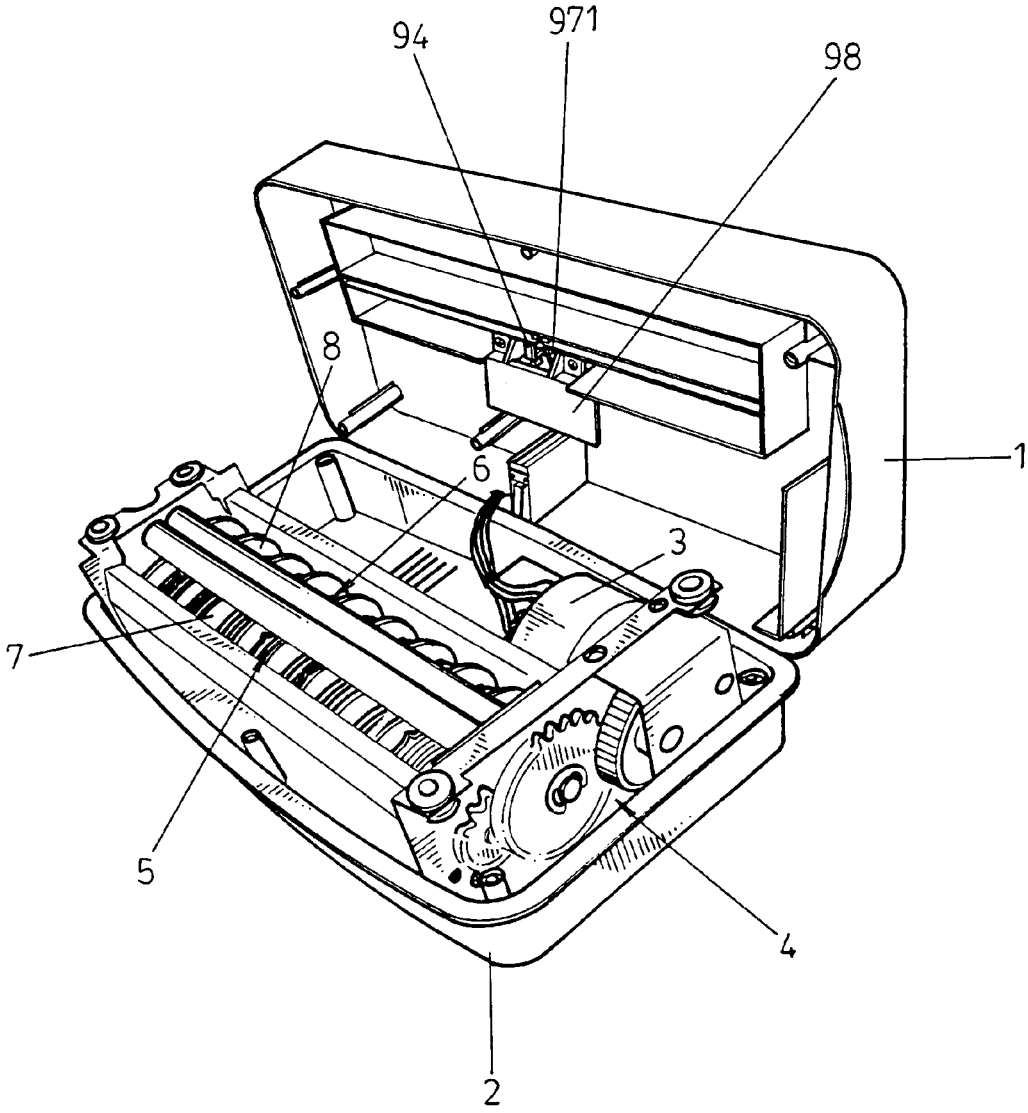
FIG. 3 shows an elevational view of the paper shredder with auxiliary switch according to the present invention.
Figure 4:
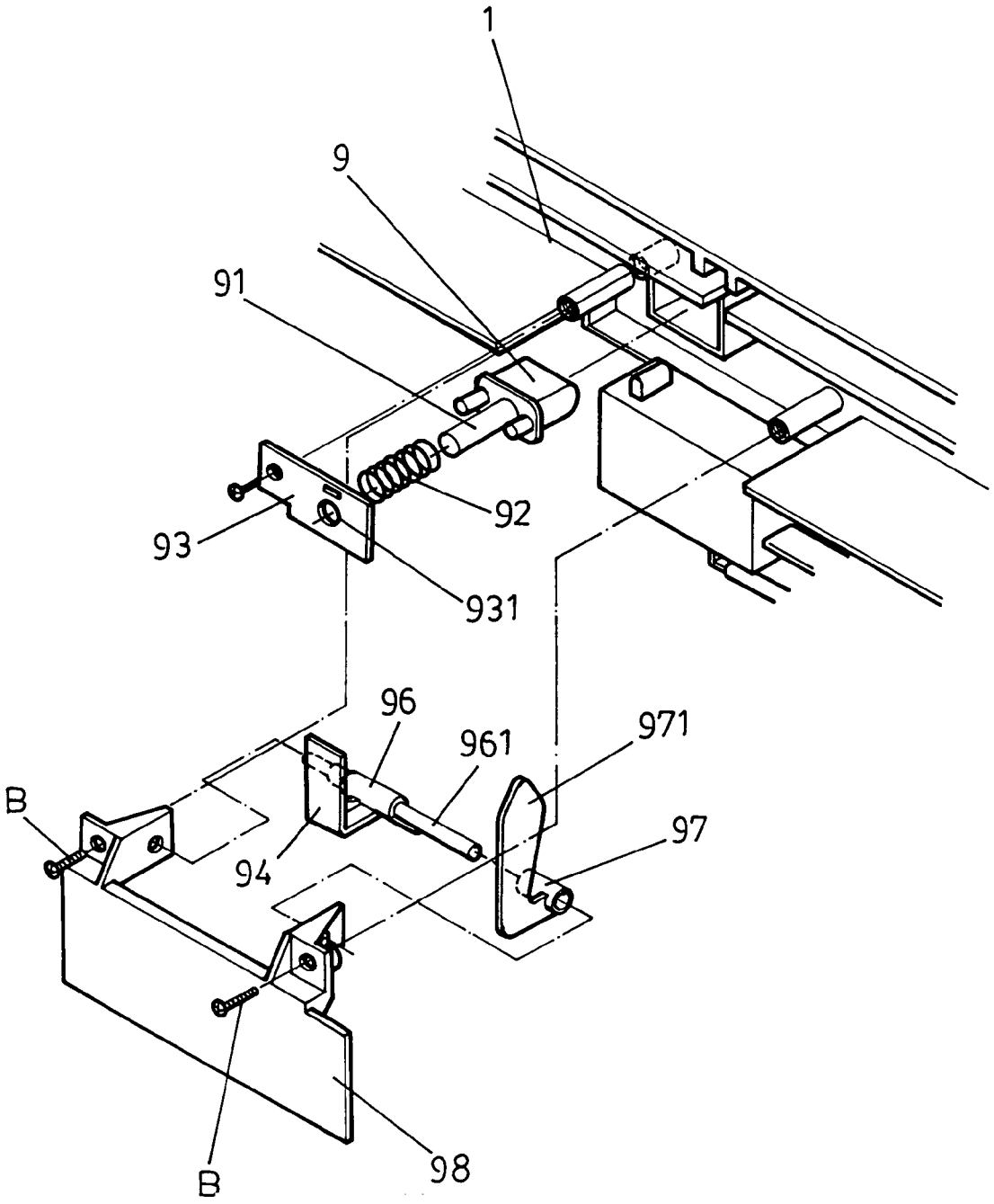
FIG. 4 shows an exploded elevational view of the auxiliary switch according to the present invention.

With reference to FIGS. 2, 3 and 4, which show a paper shredder with auxiliary switch according to the present invention comprising a top cover 1, a base 2, a motor 3, a decelerating device 4, two rotary cutters 5 and 6, and two paper guides 7 and 8.

The top cover 1 is configured with an entrance 11 defined to allow inserting of waste paper therein, and a switch 12 mounted to connect with circuits (not shown) that controls operation of the paper shredder.

The base 2 is designed to securely accommodate the motor 3, the deceleration device 4, the two rotary cutters 5 and 6, and the two paper guides 7 and 8.

Figure 5:
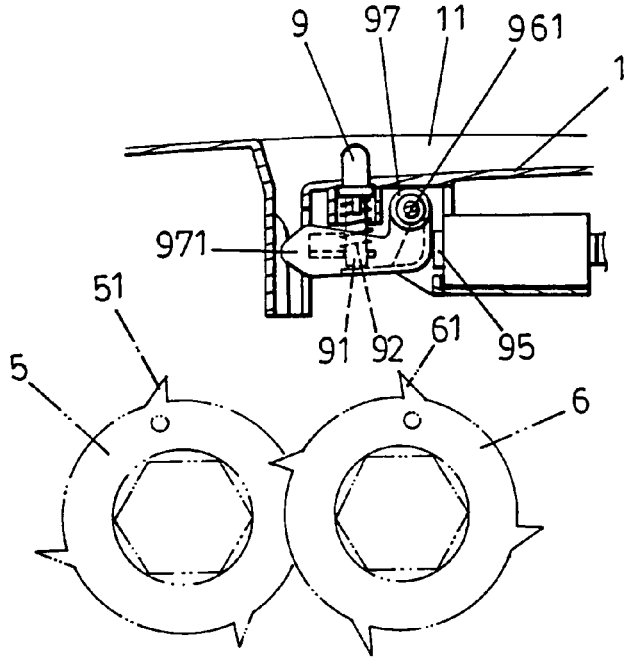
FIG. 5 shows a partial cross sectional view of the paper shredder including an auxiliary switch-according to the present invention.
Figure 6:
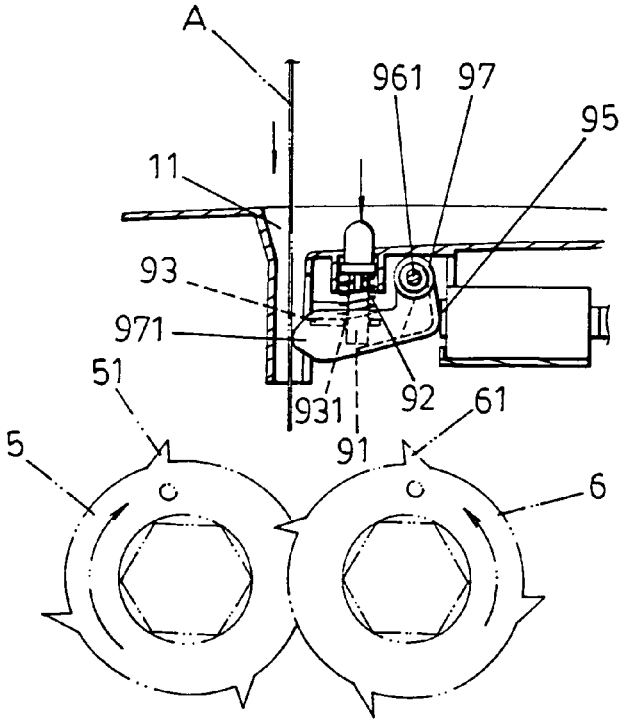
FIG. 6 shows a partial cross sectional view of the paper shredder including an auxiliary switch when operating according to the present invention.

The switch 12 is connected to the motor 3 by means of wires such that the switch 12 is able to control operation of the motor 3. The motor 3 drives the motion of the decelerating device 4, and the decelerating device 4 drives the motion of the two rotary cutters 5 and 6. Each of the two rotary cutters 5 and 6 consists of multiple cutting edges 51 and 61 respectively, as shown in FIGS. 5 and 6. And more particularly the paper shredder with auxiliary switch of the present invention is characterized in that:

Referring again to FIGS. 2 and 4, an auxiliary switch 9 is configured on a perimeter of the entrance 11 of the top cover 1. A pressure rod 91 is configured on one end of the auxiliary switch 9, and passes through an inner side of the top cover 1, and is further sleeved in a spring 92 (see FIG. 5). Pressing down on the auxiliary switch 9 compresses the spring 92 thereof, in addition to forcing the pressure rod 91 to pass through an aperture 931 defined in a flat plate 93 (see FIG. 6). Thereupon, the pressure rod 91 compresses a L-shaped contact plate 94, thereby compelling the L-shaped contact plate 94 to tilt. Thereat, the L-shaped contact plate 94 activates a contact switch 95, which thereupon actuates the motor 3 to drive into motion the two rotary cutters 5 and 6. One end of the contact plate 94 connects to a shaft lever 96, and one end of a spindle 961 of the shaft lever 96 inserts into a turning axle 97. A L-shaped paper shredder switch 971 is configured on another end of the turning axle 97. As shown in FIG. 6, upon inserting paper A that a user wishes to shred into the entrance 11, the sheet of paper A presses down on the paper shredder switch 971, and there the turning axle 97 affixed to one end of the paper shredder switch 971 rotates and brings into motion the shaft lever 96, thereby enabling the contact plate 94 to activate the contact switch 95 and thereat actuate the motor 3 to begin shredding of the paper A. In addition, screws B tighten down and secure an outer side of the contact switch 95 to a baffle plate 98.

It is to be understood, however, that even though numerous characteristics and advantages of the present invention are derived from the auxiliary switch 9 installed on the perimeter of the entrance of the top cover 1, ordinarily upon the paper A being inserted into the entrance 11, the paper A presses down on the contact switch 95 configured within the top cover 1, and thereby actuates the motor 3 to bring into motion the two rotary cutters 5 and 6 to shred the paper A. When the user wishes to clear away remnants of bits of shredded paper (or strips) in the entrance 11, the user can press the auxiliary switch 9 and thereby initiate cleaning away the entrance 11 of any paper remnants, thus benefiting subsequent usage of the paper shredder, as well as allowing the next user to utilize the paper shredder unhindered.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A paper shredder with auxiliary switch, comprising:

a top cover with an entrance through which waste paper is inserted;

a base to which the top cover is attached;

a motor that powers a drive mechanism;

two rotary cutters configured to operate in coordination, whereby each of the rotary cutters are configured with multiple integrally-formed blades;

a contact plate wherein the auxiliary switch is configured on a perimeter of the entrance of the top cover, a pressure rod is configured on one end of the auxiliary switch, and passes through an inner side of the top cover, and is further sleeved in a spring, pressing down on the auxiliary switch compresses the spring in addition to forcing the pressure rod to pass through an aperture defined in a flat plate, thereupon, the contact plate activates a contact switch, which then actuates the motor to drive into motion the rotary cutters, one end of the contact plate connects to a shaft lever, and one end of a spindle of the shaft lever inserts into a turning axle, a paper shredder switch is configured on another end of the turning axle, upon inserting paper into the entrance, the paper presses down on the paper shredder switch, and thereat the turning axle affixed to one end of the paper shredder switch rotates and brings into motion the shaft lever, thereby enabling the contact plate to activate the contact switch and thereat actuate the motor to begin shredding of the sheet of paper, if a user wishes to clear away remnants of bits of shredded paper in the entrance, the user can press the auxiliary switch and thereby initiate cleaning away the entrance of any paper remnants.

2. The paper shredder with auxiliary switch according to claim 1, wherein an outer side of the auxiliary switch is bolted to a baffle plate.

3. The paper shredder with auxiliary switch according to claim 1, wherein the contact plate and the paper shredder switch are designed to assume a L-shaped form.

* * * * *